US010151163B2

(12) United States Patent
Esparza et al.

(10) Patent No.: US 10,151,163 B2
(45) Date of Patent: Dec. 11, 2018

(54) EXPANDABLE JUNK MILL STABILIZER

(71) Applicant: BAKER HUGHES, A GE COMPANY, LLC, Houston, TX (US)

(72) Inventors: Cristian A. Esparza, Midland, TX (US); Athar M. Razvi, Spring, TX (US); David B. Haughton, New Braunfels, TX (US); Ernest D. Colin, Jr., Tomball, TX (US); William B. Handy, Spring, TX (US); Steve Rosenblatt, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 110 days.

(21) Appl. No.: 15/243,100

(22) Filed: Aug. 22, 2016

(65) Prior Publication Data

US 2018/0051524 A1 Feb. 22, 2018

(51) Int. Cl.
*E21B 29/00* (2006.01)
*E21B 10/32* (2006.01)

(52) U.S. Cl.
CPC ..... *E21B 29/00* (2013.01); *E21B 10/32* (2013.01)

(58) Field of Classification Search
CPC ..... E21B 17/1014; E21B 10/32
USPC ..... 166/170
See application file for complete search history.

(56) References Cited

U.S. PATENT DOCUMENTS

| | | | | |
|---|---|---|---|---|
| 4,357,122 | A | 11/1982 | Hollis, Jr. et al. | |
| 4,848,490 | A * | 7/1989 | Anderson | E21B 7/06 175/323 |
| 5,720,349 | A | 2/1998 | Pleasants et al. | |
| 6,615,933 | B1 | 9/2003 | Eddison | |
| 8,561,724 | B2 | 10/2013 | Xu | |
| 2002/0070052 | A1 | 6/2002 | Armell et al. | |
| 2004/0222022 | A1 | 11/2004 | Nevlud et al. | |
| 2014/0102797 | A1 * | 4/2014 | Mahajan | E21B 10/325 175/57 |

* cited by examiner

*Primary Examiner* — Taras P Bemko
(74) *Attorney, Agent, or Firm* — Shawn Hunter

(57) ABSTRACT

A stabilizer system articulates at least one blade independently of an extendable blade for a through tubing mill. The stabilizer can be actuated with flow, pressure or set down weight. A piston responds to flow or pressure from the surface and an elongated member can cam out the stabilizer with set down weight on the extendable blades.

22 Claims, 2 Drawing Sheets

EXPANDABLE JUNK MILL STABILIZER

FIELD OF THE INVENTION

The field of the invention is borehole milling tools and more particularly milling tools that increase in radial dimension mechanically when in proximity of the object to be milled and are stabilized by at least one articulated stabilizer.

BACKGROUND OF THE INVENTION

Sometimes objects need to be milled out of a borehole. One such occasion is fracturing where a series of barriers such as plugs are set to isolate zones for delivery of high pressure fluid. After the zones are treated the barriers are commonly milled out. In some wells tubular patches have been installed for a variety of reasons such as to cover perforations that no longer producing or to reinforce the tubular string to address a variety of issues in the wall of the tubular. These patches known also as clads can be applied after the plugs are in position that later need to be milled out. The presence of a clad reduces the drift dimension of the tubular requiring a reduced diameter mill so it can pass through. This reduction in diameter to clear an obstruction increases the milling time and can result in incomplete milling because the peripheral parts of the plug are not reached by a mill made smaller to clear the smallest drift dimension that will be encountered.

Fixed outer dimension blades on mills such as illustrated in U.S. Pat. No. 5,720,349 have limited utility in such applications. One approach to the problem in the past has been to use applied pressure to move a piston in the mill that axially shifts a camming member having multiple ramp surfaces with the result being that the blades are pushed out radially through a surrounding opening as a result of the camming action. A good example of such a design is U.S. Pat. No. 8,561,724. Other examples in the same vein are U.S. Pat. No. 6,615,933; US 2002/0070052 and US 2004/0222022. U.S. Pat. No. 4,357,122 shows blades inserted into sockets on a mandrel for an end mill. The blades are fixed once installed giving the mill a constant outer dimension.

The pressure operated mills with extendable blades are expensive to build and require an array of seals that need to function in a hostile environment. Seal failures can mean that the blades either fail to extend or only partially extend. Additionally these mills tend to have large outer dimensions for the mandrel assembly as there is typically an annular cavity around the mandrel that is accessed by a port from the mandrel passage so that an annular piston can be pushed to axially shift camming members for blade extension. The camming mechanism can easily jam as it depends on axial actuator movement that then forces a taper under a blade so that the blade movement is exclusively radial. While some of these designs feature a return spring to retract the cam axially out from under the blade that has been pushed out radially, the reality is that the nature of such movements creates a real risk for a jam to an extent that the return spring will not be powerful enough to retract the blades to allow mill removal.

The present invention avoids the cost and complexity of pressure actuated blades that are cammed to move in a radial direction with a simple and innovative design that relies on set down weight on the blades to move them along a dovetail so that they radially extend as they are pushed relatively axially with respect to the mandrel. The blades are secured for running in so that the mill outer periphery is at the smallest dimension. Setting down weight releases a retainer and energizes a return spring that is held compressed during milling. Picking up the mill allows the spring to reverse the blade movement with respect to the mandrel for retraction of the blades. In another aspect of the invention, at least one stabilizer can be extended after the mill passes through tubing with the blades retracted so that the mill is stabilized with the blades extended during the milling operation. These and other aspects of the present invention will become more apparent from a review of the description of the preferred embodiment and the associated drawings while recognizing that the full scope of the invention is to be determined from the appended claims.

SUMMARY OF THE INVENTION

A borehole mill has blades that extend radially while moving along an inclined dovetail as a result of setting down weight on a mandrel. The blades extend axially beyond the end of the mandrel so that setting down weight disables a retainer that has the blades retracted for running in. Axial displacement of the blades along respective dovetails breaks a shear pin on a follower sleeve that is spring biased off a gage ring on the mandrel such that the spring stays compressed as long as set down weight is applied and once the mill is picked up the spring pushes the blades axially along a dovetail to the radially retracted position. The mill resumes its smallest dimension for pulling out of the hole. At least one stabilizer is selectively extendable after the blades extend and before milling begins.

A stabilizer system articulates at least one blade independently of an extendable blade for a through tubing mill. The stabilizer can be actuated with flow, pressure or set down weight. A piston responds to flow or pressure from the surface and an elongated member can cam out the stabilizer with set down weight on the extendable blades.

DETAILED DESCRIPTION OF THE PREFERRED EMBODIMENT

Figure 1:
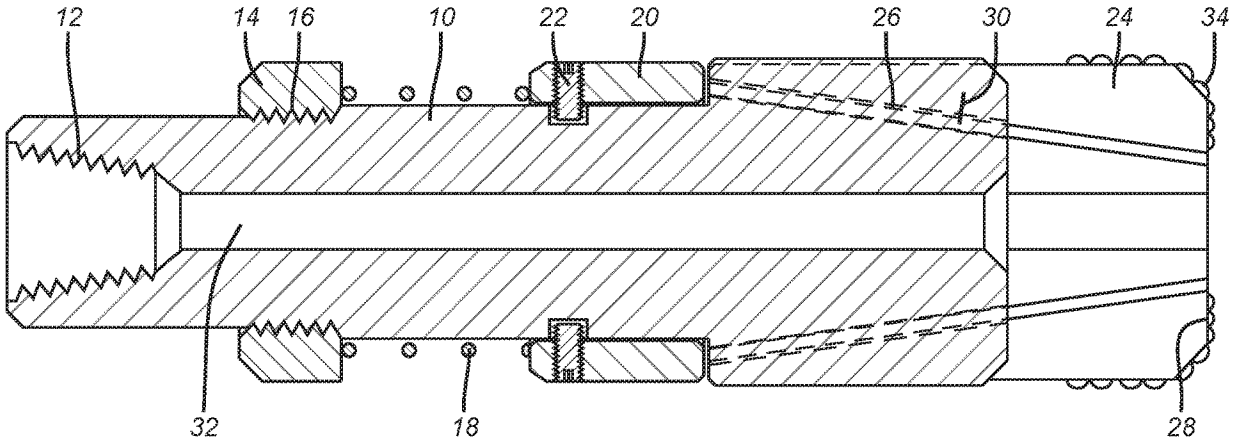
FIG. 1 is the run in position of the mill with the blades radially retracted.

Referring to FIG. 1, a mandrel 10 has a connection 12 for support from coiled or rigid tubing that is not shown. Typically with coiled tubing for the support there will also be a downhole motor to rotate the mandrel while a rigid tubing support string allows imparting rotation to mandrel 10 from a surface location. The mandrel 10 has a gage ring 14 that represents the largest dimension when running in. Ring 14 can be secured with thread 16 to the mandrel 10. Ring 16 is also a support for a coiled or other type of spring 18. Alternatively, Belleville washers or a compressed gas in a variable volume chamber can be used as equivalents to create a bias force against follower 20. Follower 20 is initially shear pinned or releasably secured to the mandrel 10 for running in. The shear pin 22 prevents movement of blades 24 along a rail such as a dovetail 26 into the FIG. 2 extended position in the event the lower ends 28 of blades 24 encounter a projection on the way to the object to be milled. A schematically represented travel stop 30 prevents the blades 24 from separating from the mandrel 10. Mandrel 10 has a passage 32 that conducts fluid from above past the blades 24 and up the hole to remove cuttings. Blades 24 have cutting structure such as carbide or hardened inserts along the bottom end 28 and continuing up the to the vertical sides of the blades 24 as shown in FIG. 1.

Figure 2:
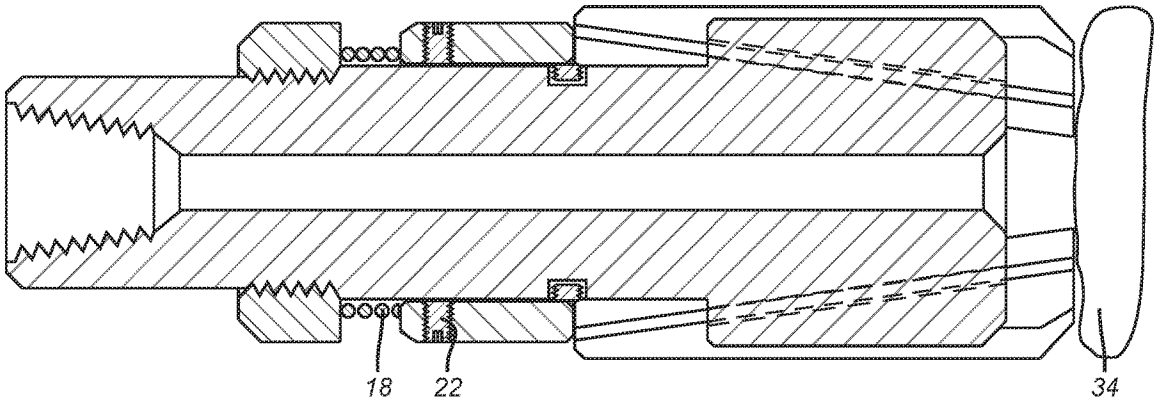
FIG. 2 is the view of FIG. 1 with the blades radially extended due to setting down weight.

In the FIG. 2 position the blades 24 have landed on the object 34 to be milled and the shear pins 22 are broken with spring 18 compressed as the blades 24 displace the follower 20. As a result of the axial relative movement between the blades which are against the object 34 to be milled and the mandrel 10 the blades also extend further radially due to the inclined orientation of the retaining dovetail 26 on which the blades 24 are guided. As an example of the amount of radial extension of the blades 24 the run in dimension for one size can be 4.375 inches and increase to 4.625 inches in the set position. The slope of the dovetail and the amount of the available axial travel determines the dimensional increase for the outer diameter of the blades 24 in the set position.

Figure 3:
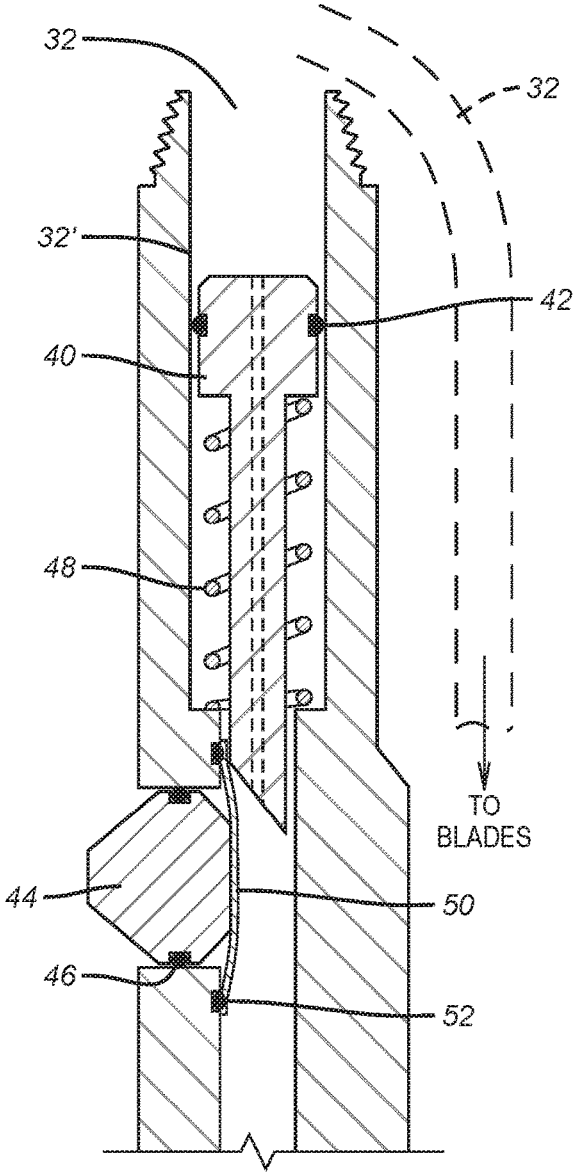
FIG. 3 is a section view of the stabilizer when retracted.
Figure 4:
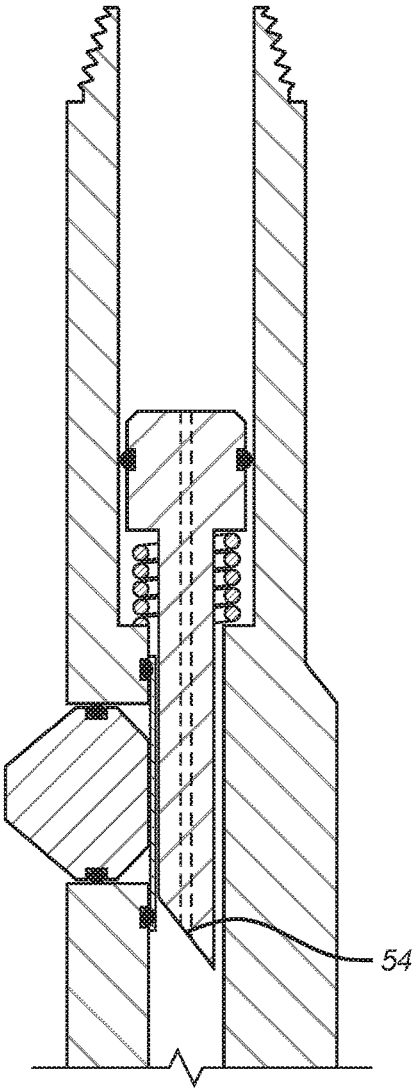
FIG. 4 is the view of FIG. 3 with the stabilizer extended.

FIGS. 3 and 4 depict a stabilizer assembly mounted above the blade assembly of FIGS. 1 and 2. There are two possible configurations. In one configuration the main passage 32 can be continued to housing 10 with flow able to get past piston 40 either by going around it if seal or seals 42 are not used and the one or more stabilizer blades 44 have a peripheral seal 46. Optionally the piston 40 can have a bore through it to promote flow to nozzles (not shown) adjacent blades 24. The flow through passage 32 creates a net force on piston 40 sufficient to overcome the biasing force which can be in the form of a spring 48 that can be a coil spring, a stack of Belleville washers or a sealed variable volume chamber with a compressible fluid, to name a few alternatives. Seal 46 insures pressure retention at blades 44 so that the fluid flow is directed toward blades 24 rather than taking a short cut with an exit around the gaps about the blades 44. Although a single blade is shown, those skilled in the art will appreciate that multiple blades are preferred that have equal extension and equal spacing circumferentially. As an alternative or in addition to the seal 46 at each blade 44 a combination of a leaf spring 50 with a peripheral seal 52 can be used to cover the opening through which the blade 44 extends. The leaf spring 50 will act to retract the blade 44 when there is no net force on the piston 40. The seal 52 prevents fluid exit around the blade 44 and when used with seal 46 is more sheltered from well fluids. Movement of the piston 40 acts as a cam to push out the blades 44.

An alternative design is to put in seals 42 on piston 40 and put piston 40 in a branch line 32' from passage 32. The back pressure from the nozzles (not shown) at cutting blades 24 will be enough to overcome the bias of the spring or equivalent 48 while directing all flow to the blades 24 and avoiding fluid loss about stabilizer blades 44. Optionally, seals 46 and 52 and leaf spring 50 can still be used as backup to seal 42.

Piston 40 can have an extending element with a slanted surface 54 to facilitate outward camming of the stabilizer blades 44. Alternatively, a sleeve 56 can be pushed up with blades 24 to mechanically extend the blades 44 as schematically illustrated in FIG. 2. A spring or other bias can push sleeve 56 down to let the blades 44 retract when the mill 10 is picked up. The blades 24 are articulated independently of the blades 44 when the blades are extended with flow or pressure. Set down weight can still make them operate at different times or the same time.

The above description is illustrative of the preferred embodiment and many modifications may be made by those skilled in the art without departing from the invention whose scope is to be determined from the literal and equivalent scope of the claims below:

We claim:

1. A borehole milling tool adapted for support on a tubular string for milling an object in the borehole, comprising:
a mandrel;
a plurality of spaced milling blades for the object in the borehole supported from said mandrel in a retracted and a radially extended positions, wherein, in said extended position, said blades extend short of the borehole so only the object in the borehole is milled;
said blades moving from said retracted to said extended position when said blades are brought into supporting contact with the object and weight is set down on the string to move said mandrel relatively to said blades;
at least one articulated stabilizer on said mandrel actuated independently from said milling blades.

2. The tool of claim 1, wherein:
said stabilizer is extended with pressure in a passage of said mandrel.

3. The tool of claim 2, wherein:
said passage comprises a first branch leading to said blades and a second branch leading to a sealed movable piston whose movement against a bias in response to applied pressure in said second branch moves said stabilizer through said wall opening.

4. The tool of claim 1, wherein:
said stabilizer is extended with flow in a passage of said mandrel.

5. The tool of claim 1, wherein:
said stabilizer is extended with relative movement between said mandrel and an elongated member in said passage that selectively contacts said stabilizer.

6. The tool of claim 5, wherein:
said elongated member is biased away from said stabilizer.

7. The tool of claim 1, wherein:
said stabilizer is selectively extended through at least one wall opening from said passage in said mandrel while being sealingly mounted thereto.

8. The tool of claim 7, wherein:
said stabilizer is biased into said passage.

9. The tool of claim 8, wherein:
said bias on said stabilizer comprises a leaf spring covering said wall opening.

10. The tool of claim 7, wherein:
said stabilizer is pushed radially through said wall opening by a piston mounted in said passage whose selective movement responsive to flow around or through said piston overcomes a bias to engage said stabilizer for extension thereof.

11. A borehole milling tool for milling an object in the borehole, comprising:
a mandrel;
a plurality of spaced blades supported from said mandrel in a retracted and extended positions;
said blades moving from said retracted to said extended position when brought into contact with the object and said mandrel moves relatively to said blades;
at least one articulated stabilizer on said mandrel;
said stabilizer is selectively extended through at least one wall opening from said passage in said mandrel while being sealingly mounted thereto;
said stabilizer is biased into said passage;
said bias on said stabilizer comprises a leaf spring covering said wall opening;

said leaf spring comprising a seal disposed in said passage around said wall opening.

12. A milling tool adapted for support on a tubular string for milling an object within a borehole, comprising:

a mandrel having a passage therethrough with at least one extendable milling structure for the object, said milling structure radially extendable with set down weight transmitted through the tubular string on said mandrel with said milling structure against the object, wherein said milling structure in the radially extended position extends over the object and short of the borehole;

at least one articulated stabilizer operable independently of said extendable milling structure.

13. The tool of claim 12, wherein:

said stabilizer is extended with pressure in a passage of said mandrel.

14. The tool of claim 13, wherein:

said passage comprises a first branch leading to said blades and a second branch leading to a sealed movable piston whose movement against a bias in response to applied pressure in said second branch moves said stabilizer through said wall opening.

15. The tool of claim 12, wherein:

said stabilizer is extended with flow in a passage of said mandrel.

16. The tool of claim 12, wherein:

said stabilizer is extended with relative movement between said mandrel and an elongated member in said passage that selectively contacts said stabilizer.

17. The tool of claim 16, wherein:

said elongated member is biased away from said stabilizer.

18. The tool of claim 12, wherein:

said stabilizer is selectively extended through at least one wall opening from said passage in said mandrel while being sealingly mounted thereto.

19. The tool of claim 18, wherein:

said stabilizer is biased into said passage.

20. The tool of claim 19, wherein:

said bias on said stabilizer comprises a leaf spring covering said wall opening.

21. The tool of claim 18, wherein:

said stabilizer is pushed radially through said wall opening by a piston mounted in said passage whose selective movement responsive to flow around or through said piston overcomes a bias to engage said stabilizer for extension thereof.

22. A borehole milling tool, comprising:

a mandrel having a passage therethrough with at least one extendable cutting structure;

at least one articulated stabilizer operable independently of said extendable cutting structure;

said stabilizer is selectively extended through at least one wall opening from said passage in said mandrel while being sealingly mounted thereto;

said stabilizer is biased into said passage;

said bias on said stabilizer comprises a leaf spring covering said wall opening;

said leaf spring comprising a seal disposed in said passage around said wall opening.

* * * * *